US009561450B1

(12) United States Patent
Chung

(10) Patent No.: US 9,561,450 B1
(45) Date of Patent: Feb. 7, 2017

(54) HURDLE

(71) Applicant: Meng-Lun Chung, Changhua (TW)

(72) Inventor: Meng-Lun Chung, Changhua (TW)

( * ) Notice: Subject to any disclaimer, the term of this patent is extended or adjusted under 35 U.S.C. 154(b) by 0 days.

(21) Appl. No.: 14/846,806

(22) Filed: Sep. 6, 2015

(51) Int. Cl.

| | |
|---|---|
| ***A63K 3/00*** | (2006.01) |
| ***A63B 5/00*** | (2006.01) |
| ***A63B 5/16*** | (2006.01) |
| ***A63K 3/04*** | (2006.01) |
| ***A63B 5/02*** | (2006.01) |
| ***A63B 71/00*** | (2006.01) |
| *A63B 1/00* | (2006.01) |

(52) U.S. Cl.
CPC ..... *A63K 3/043* (2013.01); *A63B 71/0054* (2013.01); *A63B 1/00* (2013.01); *A63B 1/005* (2013.01); *A63B 5/00* (2013.01); *A63B 5/02* (2013.01); *A63B 2244/08* (2013.01); *A63B 2244/088* (2013.01); *A63K 3/00* (2013.01); *A63K 3/04* (2013.01)

(58) Field of Classification Search
CPC ..... A63K 3/00; A63K 3/04; A63K 3/043; A63K 3/046; A63B 71/0054; A63B 2071/0063; A63B 2071/0072; A63B 2071/0081; A63B 2071/009; A63B 2244/08; A63B 2244/082; A63B 2244/084; A63B 2244/085; A63B 2244/087; A63B 2244/088; A63B 1/00; A63B 1/005; A63B 3/00; A63B 17/00; A63B 17/02; A63B 17/04; A63B 21/023; A63B 21/025; A63B 21/026; A63B 21/027; A63B 21/0421; A63B 21/045; A63B 21/0455
See application file for complete search history.

(56) References Cited

U.S. PATENT DOCUMENTS 1,737,108 A * 11/1929 Craig ..... A63B 5/02 482/17
3,384,367 A * 5/1968 Baum ..... A63K 3/043 482/17

FOREIGN PATENT DOCUMENTS

| | | | | |
|---|---|---|---|---|
| CN | 203154843 U | * | 8/2013 | |
| CN | 203264300 U | * | 11/2013 | |
| CN | 204656016 U | * | 9/2015 | |
| CN | 205028521 U | * | 2/2016 | |
| DE | WO 03022386 A1 | * | 3/2003 | ..... A63K 3/043 |
| DE | WO 2011110980 A1 | * | 9/2011 | ..... A63K 3/046 |
| JP | 08309040 A | * | 11/1996 | |

OTHER PUBLICATIONS

English Translation (9 pages) of the Description of JP 08309040 A—Patent Translate Powered by EPO and Google.*

* cited by examiner

*Primary Examiner* — Joshua Lee

(57) ABSTRACT

A hurdle has a supporting frame and two crossing rods. The two crossing rod each respectively employing a connecting joint, a spring, an engaging member, and a locking screw engageable with two opposing standing bars. The supporting frame includes the two standing bars and a horizontal aperture. The crossing rod has a hollow rod body, a soft protector jacketed onto the rod body, and a secure aperture disposed through an end of crossing rod. The connecting joint includes a hollow tubal structure with an axial hole, a connecting section with a smaller diameter is disposed at an end, a combining aperture disposed on the connecting section. An end of the spring is a hook end and another end is a screw stem having a threaded section and an inner threaded aperture, and the hook end of the spring is placed into the connecting joint through the axial hole.

7 Claims, 6 Drawing Sheets

HURDLE

BACKGROUND OF THE INVENTION

1. Field of the Invention

The present invention relates to a hurdle, and more particularly to a hurdle with a high safety factor.

2. Description of the Related Art

Hurdle sport was originated in England and becoming the track and field events more than one hundred years of history. The first hurdles competition also called steeplechase, utilized heavy and dangerous wooden frame or wooden fence buried in the ground across. After year 1900, there has been movable inverted T-shaped supporting frame, which also contributed to the development of hurdle technology. By the year 1935, the game began to use the L-shaped supporting frame which has increased bottom weigh, so that the horizontal plate at the top of the supporting frame can forward spilled by being impacted with 3.6 to 4 kg of collision forces, and the supporting frame structure that has been in use ever since.

But, although when conventional hurdles can be spilled by the forward momentum, serve to slow down the player accidentally bumping into the supporting frame suffered a reverse resistance. But because the horizontal plate at the top of hurdles are still mostly made of hard material, under the high-speed collision, it still can cause players injured.

Therefore, it is desirable to provide an improved hurdle structure to mitigate and/or obviate the aforementioned problems.

SUMMARY OF THE INVENTION

An objective of the present invention is to provide an improved hurdle structure.

In order to achieve the above mentioned objective, a hurdle includes a supporting frame, two crossing rod, a connecting joint, a spring, an engaging member and a locking screw. The two crossing rods each respectively is engageable with two opposing standing bars of the supporting frame. A bottom rod is provided at a bottom position of the supporting frame, two sides of the bottom rod respectively extend upward to form the standing bar and extend backwardly to form an extended rod, and the bottom rod, the standing bars and the extended rods form a supporting frame with an L shape. Furthermore, a horizontal aperture is respectively disposed in each standing bar. The crossing rod has a hollow rod body, a soft protector is jacketed onto the rod body, and a secure aperture is disposed through an end of crossing rod. The soft protector is made of a sponge material or a foam material.

The connecting joint includes a hollow tubal structure with an axial hole, a connecting section with a smaller diameter is disposed at an end, a combining aperture is disposed on the connecting section, and the connecting section of the connecting joint is inserted into the rod body of the crossing rod such that the combining aperture and the secure aperture are aligned with each other. An end of the spring is a hook end and another end is a screw stem having a threaded section and an inner threaded aperture. The hook end of the spring is placed into the connecting joint through the axial hole, and a screw is placed through and engaged with the secure aperture and the combining aperture and also hooked by the hook end in the connecting joint. Therefore, the spring engages with the crossing rod through the connecting joint, and the threaded section of the screw stem is locked with the spring and extends from another end of the connecting joint. The engaging member has a first end and a second end, the first end is provided with a combining column with a smaller diameter, the second end is provided with a stepped through hole passing through the combining column of the first end. The stepped through hole at the second end of the engaging member covers the spring extending from the connecting joint such that the two crossing rods are capable of being continuously placed between the two standing bars. The combining column is disposed in the horizontal aperture, and the locking screw is disposed through the horizontal aperture of the standing bar and the stepped through hole to enter into the engaging member and lock with the inner threaded aperture of the screw stem. Therefore, the crossing rod is attached onto the standing bar of the supporting frame via the spring, and the locking screw is capable of adjusting the tension strength provided by the spring.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
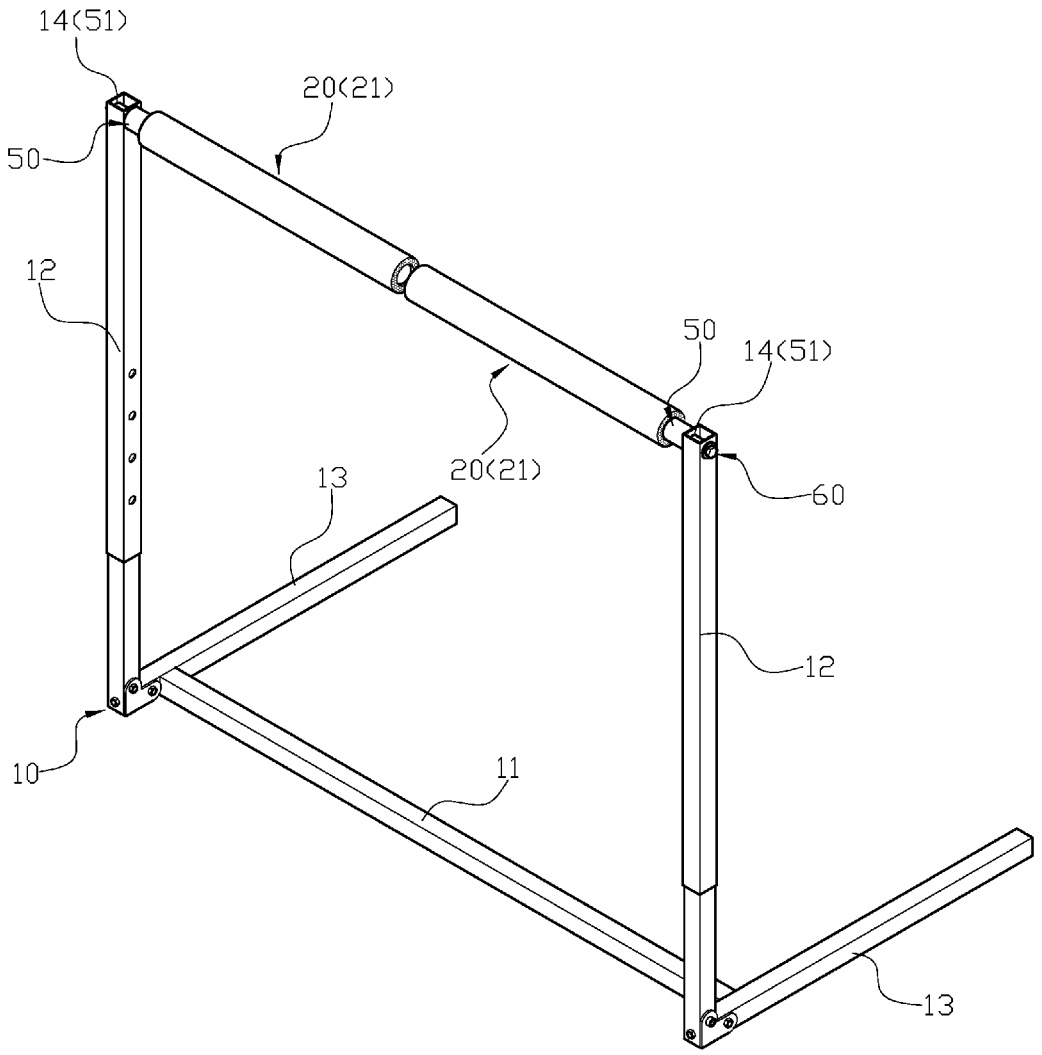
FIG. 1 is a perspective assembly drawing of an embodiment of the present invention.
Figure 2:
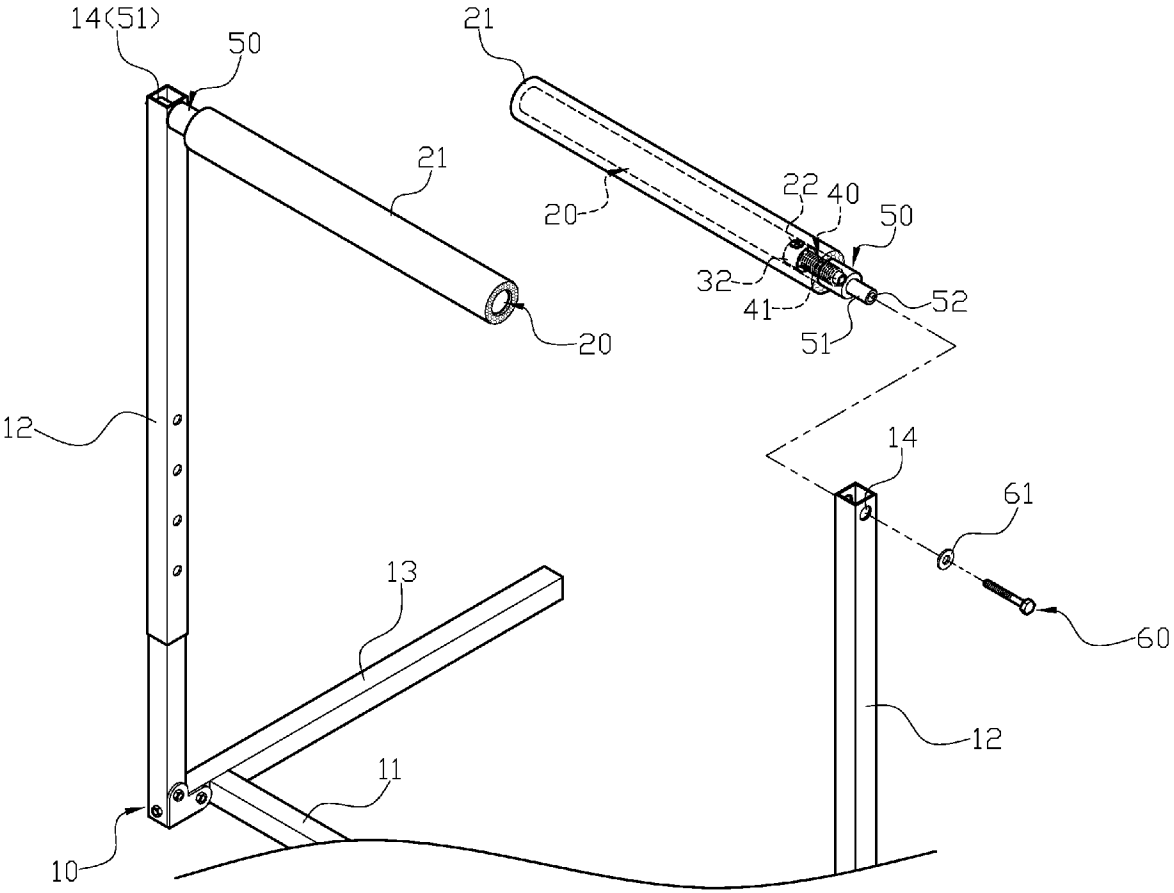
FIG. 2 is an exploded view of the embodiment of the present invention.
Figure 3:
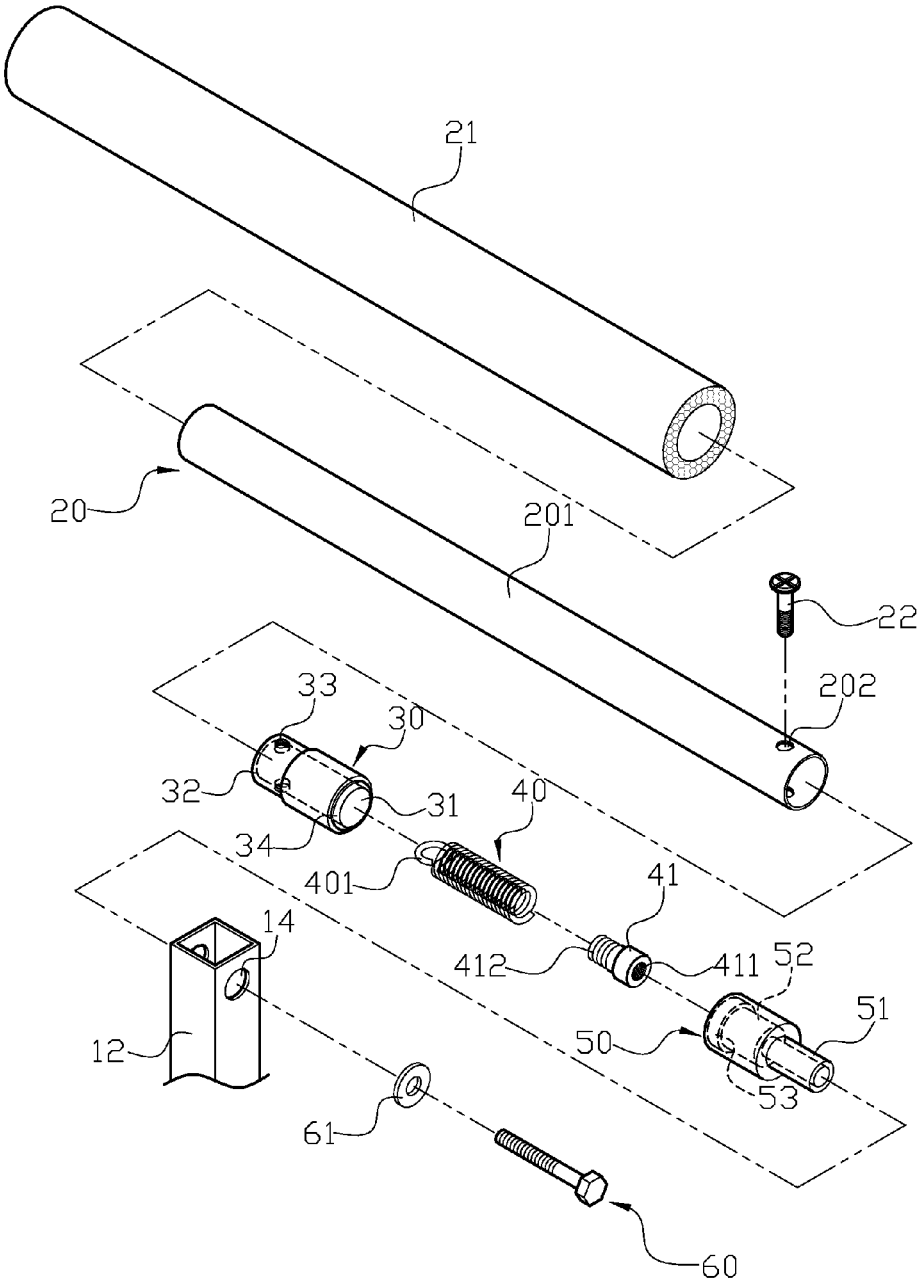
FIG. 3 is a local detail drawing of the embodiment of the present invention.
Figure 4:
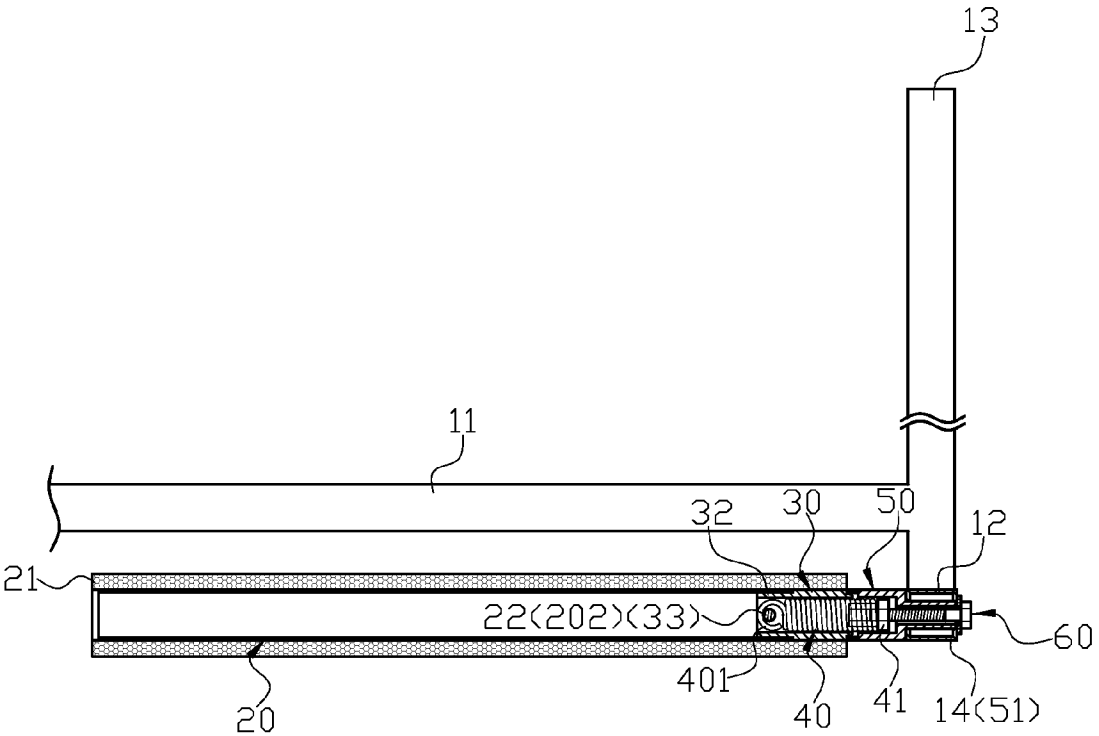
FIG. 4 is a cross-sectional view of a local assembly of the embodiment of the present invention.
Figure 5:
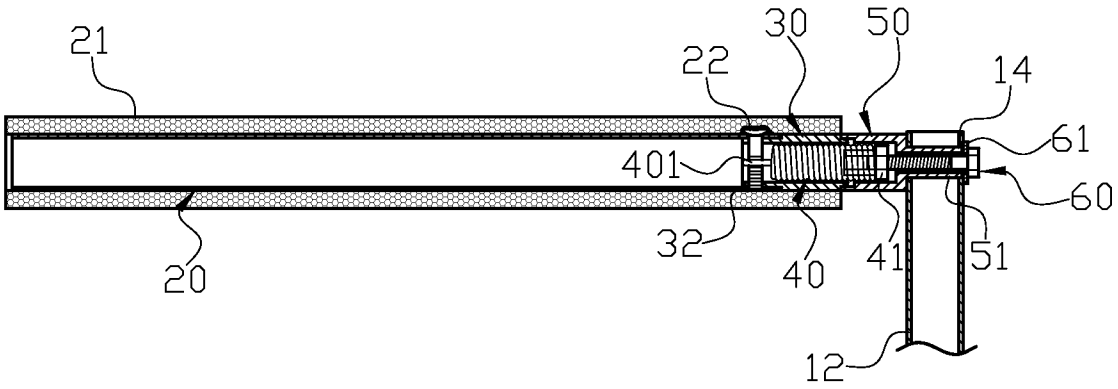
FIG. 5 is another cross-sectional view of a local assembly of the embodiment of the present invention.

Please refer to FIG. 1 to FIG. 5. A hurdle comprises a supporting frame 10, two crossing rod 20, a connecting joint 30, a spring 40, an engaging member 50 and a locking screw 60. The two crossing rods 20 each respectively is engageable with two opposing standing bars 12 of the supporting frame 10. A bottom rod 11 is provided at a bottom position of the supporting frame 10, two sides of the bottom rod 11 respectively extend upward to form the standing bar 12 and extend backwardly to form an extended rod 13, and the bottom rod 11, the standing bars 12 and the extended rods 13 form a supporting frame 10 with an L shape. Furthermore, a horizontal aperture 14 is respectively disposed in each standing bar 12. The crossing rod 20 has a hollow rod body 201, a soft protector 21 is jacketed onto the rod body 201, and a secure aperture 202 is disposed through an end of crossing rod 20. The soft protector 21 is made of a sponge material or a foam material.

The connecting joint 30 includes a hollow tubal structure with an axial hole 31, a connecting section 32 with a smaller diameter is disposed at an end, a combining aperture is 33 disposed on the connecting section 32, and the connecting section 32 of the connecting joint 30 is inserted into the rod body 201 of the crossing rod 20 such that the combining aperture 33 and the secure aperture 202 are aligned with each other. An end of the spring 40 is a hook end 401 and another end is a screw stem 41 having a threaded section 412 and an inner threaded aperture 411. The hook end 401 of the spring 40 is placed into the connecting joint 30 through the axial hole 31, and a screw 22 is placed through and engaged with the secure aperture 202 and the combining aperture 33 and also hooked by the hook end 401 in the connecting joint 30. Therefore, the spring 40 engages with the crossing rod 20 through the connecting joint 30, and the threaded section 412 of the screw stem 41 is locked with the spring 40 and extends from another end of the connecting joint 30. The engaging member 50 has a first end and a second end, the first end is provided with a combining column 51 with a smaller diameter, the second end is provided with a stepped through hole 52 passing through the combining column 51 of the first end. The stepped through hole 52 at the second end of the engaging member 50 covers the spring 40 extending from the connecting joint 30 such that the two crossing rods 20 are capable of being continuously placed between the two standing bars 12. The combining column 51 is disposed in the horizontal aperture 14, and the locking screw 60 is disposed through the horizontal aperture 14 of the standing bar 12 and the stepped through hole 52 to enter into the engaging member 50 and lock with the inner threaded aperture 411 of the screw stem 41. Therefore, the crossing rod 20 is attached onto the standing bar 12 of the supporting frame 10 via the spring 40, and the locking screw 60 is capable of adjusting the tension strength provided by the spring 40.

Moreover, a washer 61 is provided between the locking screw 60 and the standing bar 12.

In addition, the engaging member 50 has a recess 53 and the connecting joint 30 has a correspondingly flange 34, which can increase the combination stability between the engaging member 50 and the connecting joint 30.

Moreover, the standing bar 12 of the supporting frame 10 includes an outer tube sleeved onto an inner tube to provide an adjustable height.

Figure 6:
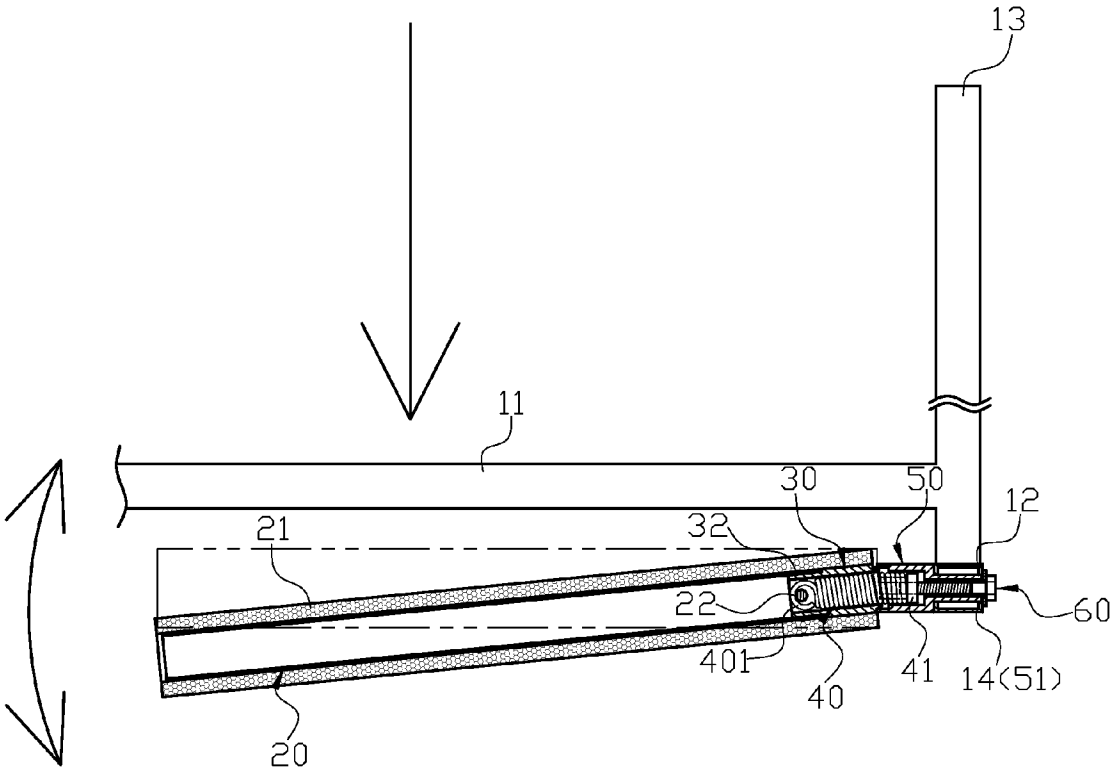
FIG. 6 is a status drawing showing the crossing rod being push away according to the embodiment of the present invention.

For actual application, the supporting frame 10 is placed on the ground, and the crossing rod 20 can flexibly swing due to the connection provided by the spring 40 as shown in FIG. 6. Since the crossing rod 20 is covered with the soft protector 21, the athletic will not be injured by the crossing rod 20.

With the above-mentioned hurdle, following benefits can be obtained: 1. The crossing rod 20 is covered with the soft protector 21, which can prevent the athletic from being injured under high speed impact. 2. The crossing rod 20 is connected to the supporting frame 10 by the spring 40, and with the spring 40 the crossing rod 20 is able to swing freely on the supporting frame 10 which also can prevent the athletic from being injured under high speed impact.

Although the present invention has been explained in relation to its preferred embodiment, it is to be understood that many other possible modifications and variations can be made without departing from the spirit and scope of the invention as hereinafter claimed.

What is claimed is:

1. A hurdle comprising:

a supporting frame and two crossing rods, the two crossing rods each respectively employing a connecting joint, a spring, an engaging member, and a locking screw engageable with two opposing standing bars of the supporting frame; wherein the supporting frame includes the two standing bars and a horizontal aperture is respectively disposed in each standing bar;

each crossing rod has a hollow rod body, a soft protector jacketed onto the rod body, and a secure aperture disposed through an end of the crossing rod;

the connecting joint includes a hollow tubal structure with an axial hole, a connecting section with a smaller diameter is disposed at an end, a combining aperture disposed on the connecting section, and the connecting section of the connecting joint is inserted into the rod body of the crossing rod such that the combining aperture and the secure aperture are aligned with each other;

an end of the spring is a hook end and another end is a screw stem having a threaded section and an inner threaded aperture, the hook end of the spring placed into the connecting joint through the axial hole, a screw is placed through and engaged with the secure aperture and the combining aperture and also hooked by the hook end in the connecting joint, the spring engages the crossing rod through the connecting joint, and the threaded section of the screw stem is locked with the spring and extends from another end of the connecting joint;

the engaging member has a first end and a second end, the first end is provided with a combining column with a smaller diameter, the second end is provided with a stepped through hole passing through the combining column of the first end, a stepped through hole at the second end of the engaging member covers the spring extending from the connecting joint such that the two crossing rods are capable of being continuously placed between the two standing bars; and the combining column is disposed in the horizontal aperture, and the locking screw is disposed through the horizontal aperture of the standing bar and the stepped through hole to enter into the engaging member and lock with the inner threaded aperture of the screw stem.

2. The hurdle as claimed in claim 1, wherein a bottom rod is provided at a bottom position of the supporting frame, two sides of the bottom rod respectively extend upwardly to form the standing bar and extend backwardly to form an extended rod, and the bottom rod, the standing bars and the extended rods form a supporting frame with an L shape.

3. The hurdle as claimed in claim 1, wherein each standing bar of the supporting frame includes an outer tube sleeved onto an inner tube to provide an adjustable height.

4. The hurdle as claimed in claim 1, wherein a washer is disposed between the locking screw and the respective standing bar.

5. The hurdle as claimed in claim 1, wherein the soft protector is made of a sponge material.

6. The hurdle as claimed in claim 1, wherein the soft protector is made of a foam material.

7. The hurdle as claimed in claim 1, wherein the engaging member has a recess and the connecting joint has a flange.

* * * * *